US005226840A

United States Patent [19]

Wojtanek

[11] Patent Number: 5,226,840

[45] Date of Patent: Jul. 13, 1993

[54] ELECTRICAL CONNECTOR TERMINAL AND CONTACT

[75] Inventor: Guy A. Wojtanek, West Chicago, Ill.

[73] Assignee: Eaton Corporation, Cleveland, Ohio

[21] Appl. No.: 706,470

[22] Filed: May 28, 1991

[51] Int. Cl.[5] ..... H01R 13/40

[52] U.S. Cl. ..... 439/733; 29/884; 29/874; 439/692

[58] Field of Search ..... 439/692, 885, 741, 751, 439/387, 443, 444, 398, 660, 395, 733; 29/874, 884

[56] References Cited

U.S. PATENT DOCUMENTS

| | | | |
|---|---|---|---|
| 3,437,772 | 4/1969 | Piber | 29/874 |
| 3,609,861 | 10/1971 | Allison | 28/884 |
| 3,727,175 | 4/1973 | Grenda et al. | 439/885 |
| 3,742,432 | 6/1973 | Curtis et al. | 439/885 |
| 3,915,543 | 10/1974 | Pfeifer et al. | 439/885 |
| 4,118,103 | 10/1978 | Leidy et al. | 439/398 |
| 4,854,041 | 8/1989 | Saito et al. | 29/884 |
| 4,927,379 | 5/1990 | Wang et al. | 439/398 |

*Primary Examiner*—David Pirlot
*Attorney, Agent, or Firm*—R. A. Johnston

[57] ABSTRACT

An electrical connector terminal formed from sheet stock of desired thickness in a "T"-shaped blank. Opposite arms of the "T"-shaped blank are folded on themselves accordion-style to form an integral head portion having a thickness of several multiples of the sheet stock thickness. An electrical contact fulcrum surface is formed on the edges of the folded material of the head portion.

12 Claims, 2 Drawing Sheets

ELECTRICAL CONNECTOR TERMINAL AND CONTACT

BACKGROUND OF THE INVENTION

In providing electrical connector terminals for low voltage applications such as found in automotive electrical circuits, it is desirable to use flat spade type pins in multiple connectors in order to minimize the size of the connector. This is particularly important where the connector pins are attached to a panel or bulkhead or to the base of a small accessory switch to permit direct connection of the switch to a wiring harness connector. Examples of such switch terminal connections are those found in the switches employed for actuating power window lift motors, rear view mirror adjustment motors, and motorized seat adjustments. The switches employed for such vehicle accessories are typically attached to a panel in a cluster and multiple pin-carrying harness connectors are connected directly to the switch bases on the backside of the switch panel.

In providing spade type or flat pin terminals for low voltage switches, it has been desired to find a way or means of attaching the terminal connector pins to the switch base structure and to provide for connection of the terminal pins to the switching contacts in a manner that is easy to control in high-volume production, low in manufacturing cost, and which minimizes the number of pieces required to install the terminal pin, the contact and make electrical connection therebetween. Heretofore, flat or spade-type connector terminal pins for automotive switching applications have been formed by cold heading and extrusion of round stock in hardened dies. This has required several stages in manufacturing operations, in order to meet the automotive manufacturer's specification for shape and dimensional control of a spade-type flat terminal pin. It has been necessary to cold head the contact end of the terminal from round stock, trim and transfer the headed piece to second stage die operations for swaging of the flat spade portion of the terminal and necessary to perform trimming operations after swaging. This technique has proven to be quite cumbersome and costly in high volume manufacturing of connector terminal pins.

SUMMARY OF THE INVENTION

The present invention provides a unique and novel spade-type or flat electrical connector and terminal pin which also serves as an electrical switch contact. The connector terminal pin of the present invention is formed by stamping a "T"-shaped blank from flat sheet stock, then folding the opposite arms of the "T"-shaped blank in accordion fashion to a closed stacked arrangement to form the head portion of the connector terminal pin. Barbs are formed on the trunk of the "T"-shaped blank which enables the connector terminal pin to be pressed into a switch base; and, the barbs thereupon prevent removal of the installed connector pin. Switch blade fulcrum surfaces are formed in the edges of the accordion-folded head and other portions of the edges adjacent the fulcrum surfaces are adapted serve as electrical switching contacts. The present invention thus provides a low-cost one-piece connector terminal pin having a flat spade-type configuration which may be formed from sheet stock and which provides a low cost alternative to cold headed and swaged pins.

DETAILED DESCRIPTION

Figure 1:
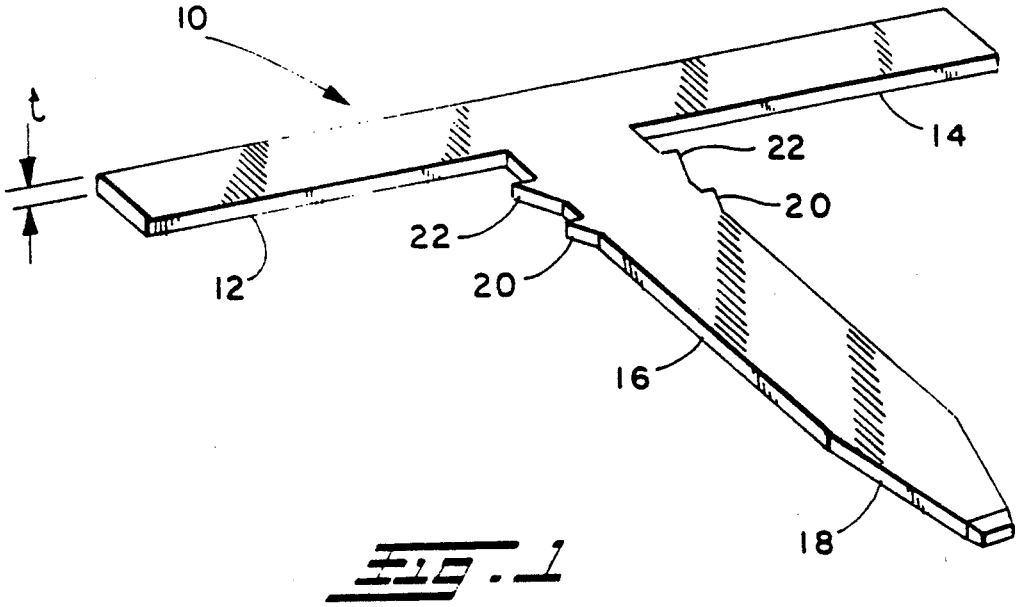
FIG. 1 is an axonometric view of the "T"-shaped blank stamped from sheet stock.

Referring to FIG. 1, a flat blank from which the terminal is formed is indicated generally at 10 in the condition as it appears after stamping from sheet stock of a desired thickness indicated by the reference character "t". The blank 10 has a pair of oppositely directed arm portions 12,14 and a terminal or spade-like trunk portion denoted by reference numeral 16 extending at right angles from arms 12,14.

The terminal portion 16 has a tapered portion 18 formed at the free end thereof to facilitate bayonet-type connection thereto as, for example, with a wiring harness connector (not shown).

The terminal portion 16 has preferably a plurality of barbs 20,22 formed on opposite sides thereof adjacent the arms 12,14 to facilitate installation of the terminal 16 in a switch base as will hereinafter be described. It will be understood that the blank 10 is formed of metal sheet stock having suitable electrical and corrosion-resistant properties such as, for example, brass material or any other material suitable for the application environment in which the terminal is to be employed.

Figure 2:
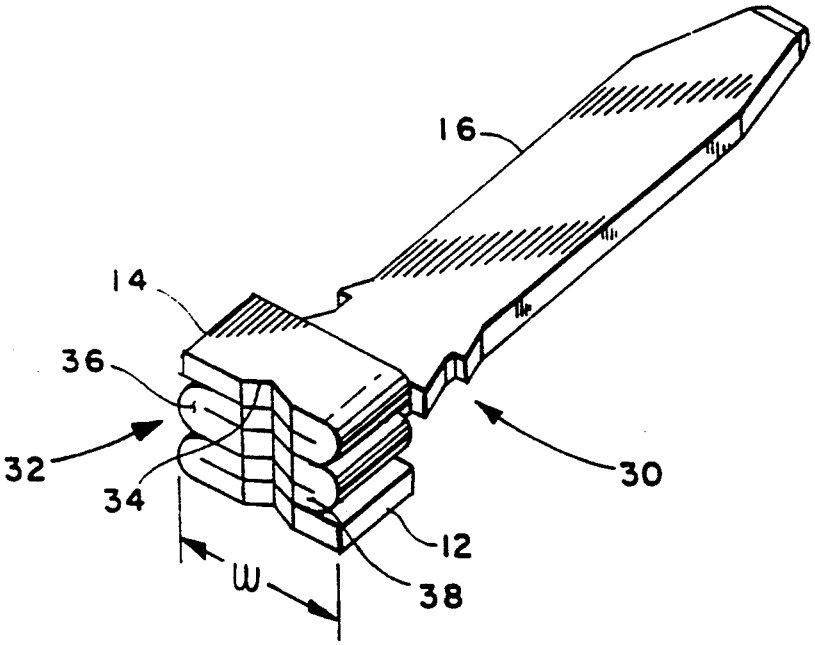
FIG. 2 is an axonometric view of the completed terminal pin formed from the blank of FIG. 1.

Referring to FIG. 2, the formed connector terminal is illustrated generally at 30 as having the arms 12,14 folded accordion-style in closed-stack serpentine arrangement to a convenient width indicated by reference character "w" to thereby form a head portion indicated generally at 32 and which is comprised of multiple thicknesses "t" of the material depending upon the number of folds in the arms 12,14. In the presently preferred practice, each of the arms 12,14 is folded back upon itself twice to give a thickness to the head portion 32 of five times the thickness "t". It will be understood that the folding may be accomplished in a single stage operation and thus renders the terminal 30 efficient to manufacture.

Upon completion of the forming of head portion 32, the fulcrumming surface in the form of a V-shaped notch 34 is formed in the edges of the folded arms for use with associated switch components as will hereinafter be described. The remaining portions of the edges of the folded arms 12,14 adjacent the notch 34 are formed to a suitably flattened configuration to provide electrical switch contact surfaces. The completed terminal 30 as illustrated in FIG. 2 thus functions as a spade-type connector terminal with respect to portion 16 and the head portion 32 serves to register the terminal in a switch base structure by contact with the undersurface of the head portion 32. The notch 34 and adjacent edge surfaces of the folded arms 12,14 serve as electrical contact surfaces and fulcrumming surfaces for associated switch components.

Figure 3:
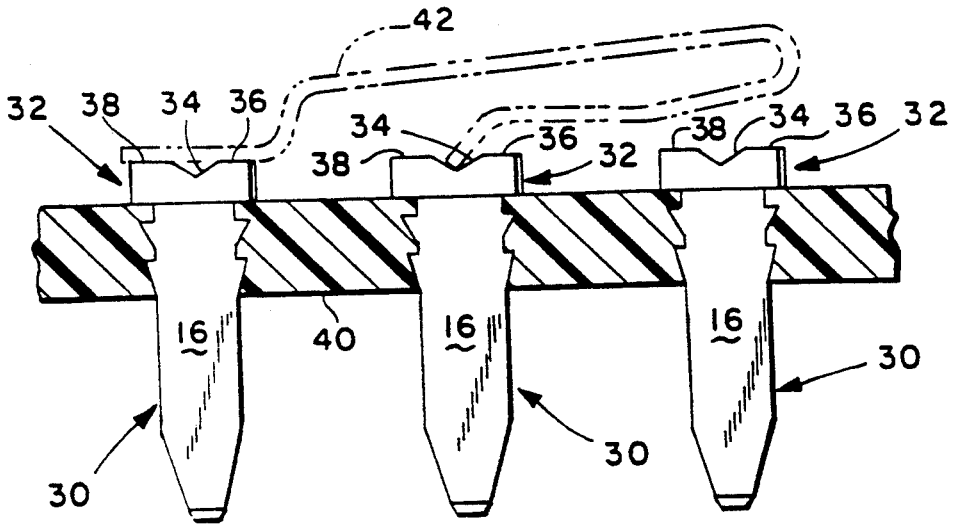
FIG. 3 is a cross-sectional view of a switch base having a plurality of the pins of FIG. 2 mounted thereon; and, FIG. 4 is a view similar to FIG. 3.
Figure 4:
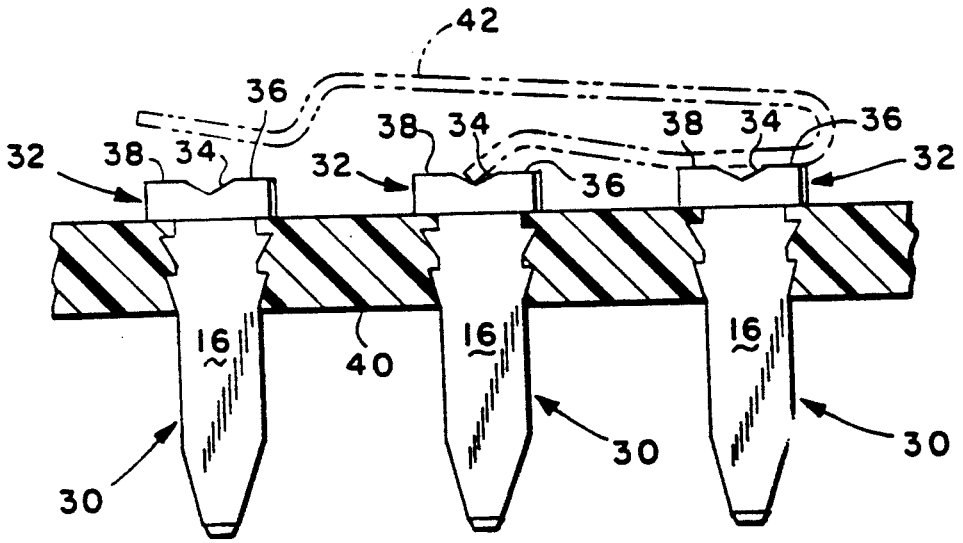

Referring to FIGS. 3 and 4, a plurality of the terminals 30 are show installed in a suitable switch base structure indicated by reference numeral 40, which may comprise any suitably configured insulating material for receiving the barbed portions of the terminal therein with the blade portion extending therethrough. In a common application, illustrated in FIGS. 3 and 4, three of the terminals 30 are disposed in aligned space relationship in the base structure 40 with the undersurface of head portion 32 of each terminal registered against the upper surface of the base structure 40 for accurate positioning. This arrangement enables a suitable pivoted switching member 42 indicated in dashed outline in FIGS. 3 and 4, to be fulcrummed in the notch 34 provided in the center of the three terminals 30. The switching member 42 may alternately pivot to make contact with the end terminals 30 to provide an electrical circuit between either of the end terminals and the center terminal. The flat portions of the terminal heads 32 indicated by reference numerals 38,36 act as switching contacts with the movable switch member 42 shown in dashed outline.

the present invention thus provides a unique and novel low cost combination spade-type connector terminal and switching contact which is formed integrally from a "T"-shaped blank stamped from flat sheet stock. The combination connector terminal and switch contact of the present invention provides a low cost alternative to cold heading and swaging a terminal from round wire stock.

Although the present invention has been described hereinabove with respect to the illustrated embodiments, it will be understood that the invention is capable of modification and variation; and, is intended as limited only by the scope of the following claims.

I claim:

1. A method of making an elongated electrical connector terminal and switch contact comprising the steps of:

(a) providing a metal sheet stock of desired thickness;

(b) forming a generally "T"-shaped blank from said sheet stock;

(c) convoluting the oppositely directed arms of said "T"-shaped blank and folding the arms in closed-stack arrangement and forming a head for said terminal; and, (d) forming a switching contact surface on the end face of said closed-end stack arrangement.

2. The method defined in claim 1, wherein the step of forming a "T"-shaped blank includes the step of forming a plurality of barbs or opposite margins of the trunk of said "T" shape.

3. The method defined in claim 1, wherein the step of forming a head for said terminal includes the step of forming a fulcrum pivot surface on the end face of said closed-stack arrangement.

4. A method of making an electrical terminal and switch contact from sheet stock comprising:

(a) forming a generally "T"-shaped blank from said stock;

(b) folding the oppositely directed arms of said "T"-shaped blank in accordian-like manner and closing said folded arms in flat stack arrangement, and forming a head for said terminal; and, (c) forming a switching contact surface on the end face of said flat stack arrangement.

5. The method claimed in claim 4, wherein the step of forming a "T"-shaped blank includes the step of forming barbs on opposite sides of the center leg of said "T" shape.

6. A method of forming an electrical connector terminal and switch contact from sheet stock comprising the steps of:

(a) forming a "T"-shaped terminal blank from said sheet stock;

(b) folding each of the oppositely directed arms of said "T"-shaped blank back on itself and forming a thickened head portion of said terminal; and, (c) forming an electrical switching contact surface on the end face of said head portion.

7. The method defined in claim 6, further comprising the step of forming a fulcrumming surface on the end face of said folded arms.

8. An electrical connector terminal and switch contact comprising:

(a) an elongated blade portion having a generally rectangular transverse section with the thickness thereof substantially less than the width;

(b) a head portion formed integrally with said blade portion at the end thereof and comprising material folded on itself to form a thickness consisting of multiples of said blade thickness; and, (c) a switching contact surface formed on the end face of said multiples of blade thickness.

9. The connector terminal defined in claim 8, wherein said head portion has a fulcrumming surface formed in the edges of said folded material.

10. The connector terminal defined in claim 8 wherein said blade portion has barbs formed on opposite edges thereof.

11. An electrical terminal and switch contact comprising:

(a) an elongated blade portion having a thickness generally thin with respect to the width in flat configuration;

(b) a head portion formed integrally with said blade portion and comprising multiple layers of material of said blade thickness folded on itself in closed-stack serpentine arrangement; and, (c) a switching contact surface formed on the end face of said closed stack.

12. The terminal defined in claim 11 further comprising a fulcrumming recess formed in the edges of said folded layers.

* * * * *